US009474126B2

(12) United States Patent
Hilbe et al.

(10) Patent No.: US 9,474,126 B2
(45) Date of Patent: Oct. 18, 2016

(54) OPERATING DEVICE FOR LIGHT-EMITTING MEANS FOR DETERMINING AN ENERGY OR POWER CONSUMPTION AND METHOD FOR DETECTING SAME

(75) Inventors: Thomas Hilbe, Dornbirn (AT); Christian Nesensohn, Götzis (AT)

(73) Assignee: Tridomic GmbH & Co. KG, Dombim (AT)

( * ) Notice: Subject to any disclaimer, the term of this patent is extended or adjusted under 35 U.S.C. 154(b) by 162 days.

(21) Appl. No.: 13/639,300

(22) PCT Filed: Apr. 8, 2011

(86) PCT No.: PCT/EP2011/055511

§ 371 (c)(1),
(2), (4) Date: Nov. 15, 2012

(87) PCT Pub. No.: WO2011/124682

PCT Pub. Date: Oct. 13, 2011

(65) Prior Publication Data

US 2013/0127359 A1 May 23, 2013

(30) Foreign Application Priority Data

Apr. 9, 2010 (DE) ..... 10 2010 003 834

(51) Int. Cl.
*H05B 37/02* (2006.01)

(52) U.S. Cl.
CPC ..... *H05B 37/02* (2013.01); *H05B 37/0245* (2013.01); *H05B 37/0254* (2013.01); *H05B 37/0272* (2013.01)

(58) Field of Classification Search
CPC ..... H05B 33/0815; H05B 37/0254; H05B 37/0272
USPC ..... 315/210, 312, 318–319, 363
See application file for complete search history.

(56) References Cited

U.S. PATENT DOCUMENTS 7,167,777 B2 * 1/2007 Budike, Jr. ..... H04L 29/06 315/292
7,208,887 B2 * 4/2007 Mosebrook ..... H05B 41/2856 315/209 R (Continued)

OTHER PUBLICATIONS

International Search Report issued in connection with the corresponding International Application No. PCT/EP2011/055511 on Dec. 21, 2011.

*Primary Examiner* — Jason M Crawford
(74) *Attorney, Agent, or Firm* — The H.T. Than Law Group

(57) ABSTRACT

Exemplary embodiments represent an operating device (100) for a light-emitting means (12) with an interface (15) for the bidirectional data interchange with a control device (20), wherein the operating device (10) has an energy or power measuring device (25) for determining an energy or power consumption of the light-emitting means. In this case, the operating device (10) is designed to send information relating to the energy or power consumption to the control device (20) or is designed such that the information relating to the energy or power consumption is accessible to the control device (20).

18 Claims, 8 Drawing Sheets

(56) References Cited

U.S. PATENT DOCUMENTS

| | | | | |
|---|---|---|---|---|
| 7,880,405 | B2 * | 2/2011 | Chitta | H05B 37/0245 315/209 R |
| 2007/0043540 | A1 * | 2/2007 | Cleland | H05B 37/0245 702/188 |
| 2007/0057807 | A1 * | 3/2007 | Walters | G06Q 30/04 340/7.29 |
| 2007/0268151 | A1 | 11/2007 | Juen et al. | |
| 2009/0299527 | A1 * | 12/2009 | Huizenga | H05B 37/0245 700/275 |
| 2010/0225240 | A1 * | 9/2010 | Shearer | H05B 37/0263 315/247 |
| 2010/0251157 | A1 * | 9/2010 | Wendt | H05B 37/0218 715/771 |
| 2011/0210681 | A1 * | 9/2011 | Barth | H05B 33/0842 315/276 |

* cited by examiner

OPERATING DEVICE FOR LIGHT-EMITTING MEANS FOR DETERMINING AN ENERGY OR POWER CONSUMPTION AND METHOD FOR DETECTING SAME

BACKGROUND OF THE INVENTION

The present invention relates to an operating device for a light-emitting means for determining an energy or power consumption and to a method for detecting information about an energy or power consumption of a light-emitting means. The operating device, according to the invention, for light-emitting means can be, for example, an electronic ballast for light-emitting means such as, e.g., gas discharge lamps or fluorescent tubes.

To implement illumination systems having a number of lamps, systems having a central control unit for controlling the operating characteristic of the lamps are used. In this context, characteristics such as operating comfort, ambience, functionality and energy saving and energy monitoring play an ever increasing role in the case of such illumination systems. The traditional electrical installation based on a simple wiring of light switches, dimmers and lighting-related loads can meet these requirements only inadequately. Modern operating devices which are linked in illumination systems can receive control commands for the operation of the corresponding light-emitting means or lamps via interfaces and then drive the light-emitting means in a correspondingly suitable manner. The control commands can then be conveyed both via a separate data or bus line or also as part of the PLC (Power Line Carrier) method via the power supply line. Furthermore, operating devices for light-emitting means are also known which have an interface for wirelessly receiving control commands.

Against this background, the lighting industry has defined a standard for digital communication between the individual components of an illumination system. This DALI (Digital Addressable Lighting Interface) standard is a protocol for controlling lighting-related operating devices such as, e.g., switched-mode power supplies, electronic ballasts or else electronic power dimmers. In this context, any operating device which has a DALI interface can be driven individually via DALI addresses. In comparison with the 1-10 volt interface frequently used previously, the DALI interface exhibits increased comfort for an intelligent light control in an illumination system. The DALI standard is an interface definition which is used especially for electronic ballasts for operating discharge lamps. DALI can also be linked as a cost-effective subsystem into a higher-level building management system via suitable converters.

A DALI light control system can be used as independent system for controlling illumination facilities. Furthermore, a DALI light control system can also be used as an independent subsystem in a pre-existing building management system. In this arrangement, a DALI system has a link to a higher-level building management system but is also operable without the building management system. In a further variant, the DALI system can be constructed as a pure subsystem in a building management system. In this type of application, the light system is not designed as a stand-alone solution. Commissioning of the light control system is in this case a component of the commissioning of the total building management system.

In principle, there are two possibilities for networking and operating a DALI light control system. As shown in FIG. 6, a control device 20 can control a number of operating devices 2 which are connected to one another via a bus 16. In this operating mode, the operating devices 2 connected are controlled by the control device 20, to which control panels or control units 40 such as, e.g., sensors, pushbuttons, dimmers or motion switches are connected. In this operating mode, the operating devices 2 forward information only on request by the control device 20. The entire handling is controlled by the control device 20.

As shown in FIG. 7, however, a number of control units 40 can also be connected to the interface line 16 and, therefore, communicate directly with the operating devices 2. In this arrangement, the control units 40 must observe corresponding "traffic rules" in the DALI standard in order to avoid data collisions and to allow the system to run correctly. In this operating mode, the installation is simpler and there is less wiring expenditure.

The control devices 20 establish the logical correlation between the control units 40 such as, e.g., sensors, operating elements and DALI operating devices 2. In principle, the control device can be an independent control device or else an interface module which obtains its instructions from a higher-level system such as, e.g., a building management system. Possible control devices 20 are also intelligent sensors or operating elements with integrated control device. As is shown in FIG. 6, sensors and operating elements 40 can be linked directly to the control device 20 via separate connections. By this means, commercially available components can then be used. In the variant as shown in FIG. 7, sensors and operating elements are linked to the control device 20 via the DALI lines 16. In this variant, no additional lines need to be run between sensors/operating elements and the control device.

In illumination systems, e.g. in buildings, the energy and power monitoring represents an ever more important aspect. In previous illumination systems comprising operating devices for light-emitting means, the energy consumption could hitherto only be estimated or determined via the measured total consumption. Estimation can take place by estimating the average dimming value or brightness value set and taking into consideration the corresponding power consumption of the installed operating devices. However, estimation of the energy consumption is rather cumbersome, on the one hand, and, on the other hand, also inaccurate since, for example, a real energy consumption of a light-emitting means can change in dependence on the duration of operation and thus in dependence on heating, when a dimming value is adjusted.

SUMMARY OF THE INVENTION

It is the object of the present invention, therefore, to provide an operating device for light-emitting means which allows the energy or power consumption of the light-emitting means to be provided for a control device in an illumination system in a simple and accurate manner.

This object is achieved by the operating device as claimed in claim 1 and the method as claimed in claim 11. Advantageous developments of the invention are specified in the subclaims.

The present invention is characterized by the fact that an operating device for a light-emitting means has an energy or power measuring device for determining an energy or power consumption of the light-emitting means. With the aid of this operating device, the energy or power consumption of such an operating device can be determined in a very simple and very accurate manner within an illumination system.

According to an exemplary embodiment, an operating device can have a data memory which, for example, records the energy or power consumption over a certain period of time. This value can then be read out, for example intermittently or cyclically by a control system or control device, or sent to it. According to a further exemplary embodiment of the present invention, the control device can always deposit the current energy or power consumption in a second register or memory bank so that it can always be called up currently or sent to the control device.

BRIEF DESCRIPTION OF THE DRAWINGS

In the text which follows, preferred exemplary embodiments of the invention will be explained in greater detail with reference to the attached drawings, in which.

DETAILED DESCRIPTION OF THE INVENTION

With respect to the following description of the exemplary embodiments of the present invention, it should be noted that, in the different figures, the same reference symbols are used in the entire description for identically acting or functionally equal elements or steps for the purpose of simplification. These elements having identical reference symbols are mutually interchangeable in the various exemplary embodiments.

Figure 1:
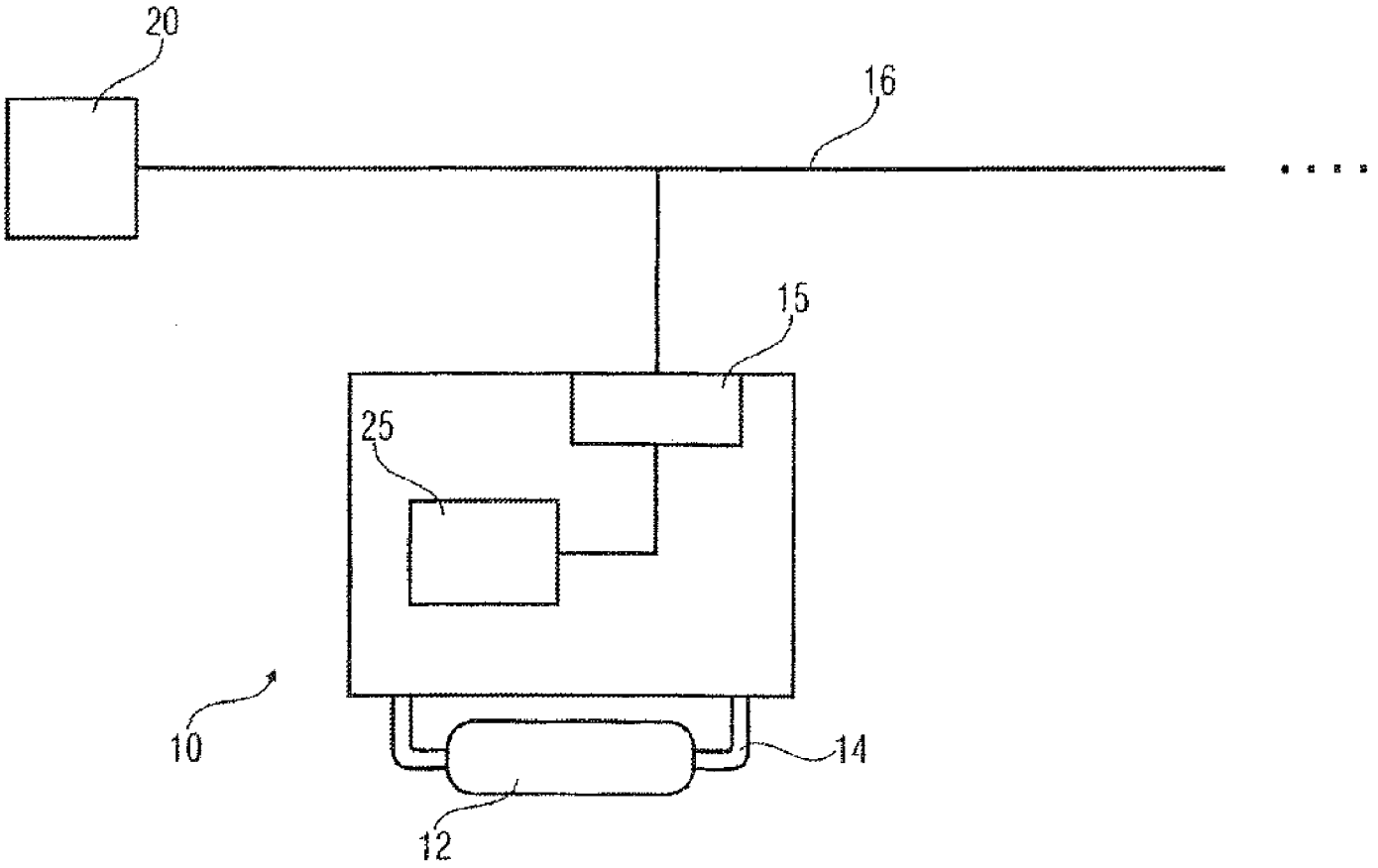
FIG. 1 shows the diagrammatic representation of an operating device for a light-emitting means with an interface and an energy or power measuring device according to one exemplary embodiment of the present invention.

FIG. 1 shows in a diagrammatic representation an operating device 10 for a light-emitting means 12 with an interface 15 for the bidirectional data exchange with a control device 20. Light-emitting 12 is connected to the operating device 10 through lead wires 14. The operating device 10 has an energy or power measuring device 25 for determining an energy or power consumption of the light-emitting means 12. The operating device 10 is also constructed for sending information about the energy or power consumption to the control device 20 or for making the information about the energy or power consumption accessible to the control device 20.

Figure 6:
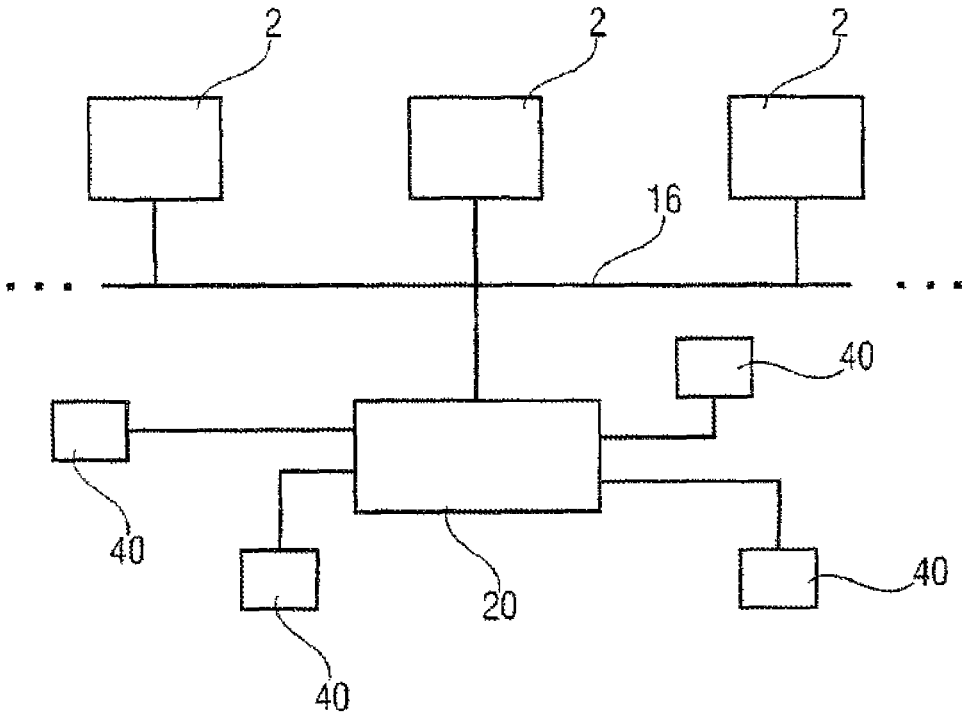
FIG 6 (PRIOR ART)
FIG. 6 shows a diagrammatic representation of a DALI light control system, wherein sensors and operating elements are linked to a control device via separate connections.
Figure 7:
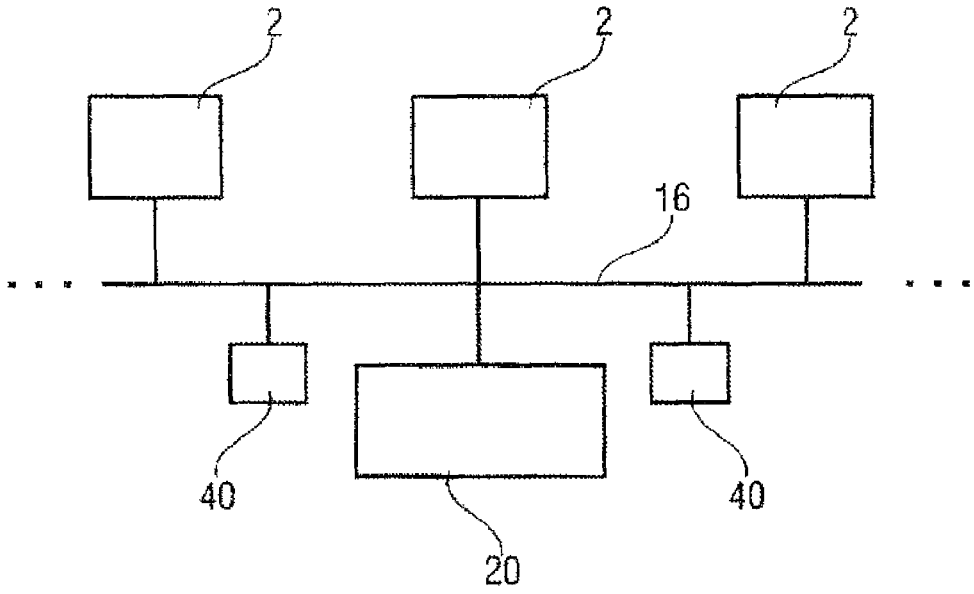
FIG 7 (PRIOR ART)
FIG. 7 shows the diagrammatic representation of a DALI light control system, wherein sensors and operating elements are linked to a control device via the DALI bus.

The lamp operating device 10 can be a part of a larger illumination system which, as is also shown in conjunction with FIGS. 6 and 7, can have a plurality of further lamp operating devices which, for example, are arranged distributed within a building or a facility to be illuminated. In this context, the individual operating devices 10 can be connected to a central control device 20 via a bus system 16. With the aid of the bus system 16, control commands can be sent, for example, to an operating device 10, and status information can be interrogated or sent by the operating device 10 to the control device 20, by the central control unit. According to exemplary embodiments of the present invention, information with respect to the energy or power consumption of the light-emitting means 12 can be sent to the control device 20 or made accessible, for example, also via the bus system 16 and the interface 15 or else via a further interface as will still be shown later.

The operating device 10 can be, for example, an electronic ballast for light-emitting means such as, e.g., discharge lamps or gas discharge lamps. An electrical ballast can cooperate with the light-emitting means 12 as a separate component or else be integrated in the light-emitting means. An electronic ballast can be used for igniting a gas discharge with a correspondingly high voltage and limiting a discharge current during the operation of the gas discharge lamp. Since an operating device can have a certain intrinsic energy consumption, the energy or power measuring device 25 can be constructed for determining the entire energy consumption from light-emitting means and operating device. Correspondingly, the information about an energy or power consumption of the operating device can then comprise both the energy and power consumption of the operating device and also of the light-emitting means per se.

In other exemplary embodiments, the operating device 10 can be a ballast for light-emitting means, for an emergency current module, for a dimmer, for a transformer etc.

The operating device 10 can be an operating device for different types of light-emitting means. The light-emitting means can comprise, for example, gas discharge lamps, incandescent lamps, incandescent halogen lamps or semiconductor light sources.

The operating device 10 shown in FIG. 1 can be, for example, a DALI operating device which then correspondingly has a DALI interface 15 by means of which the operating device is connected via a DALI bus 16 to a DALI control device 20 or a DALI gateway 20 if the illumination system is a subsystem of a building management system.

The energy or power measuring device 25 can be constructed for detecting a corresponding active current, if there is a phase shift between current and voltage, and the instantaneously present alternating voltage, and calculating from this a power consumption by multiplication, by means of which an energy consumption can be determined during a subsequent temporal integration. For example, when a resonant halfbridge is used for operating the light-emitting means, the current and the voltage through the light-emitting means can be detected, the active current or, respectively, the active power of the light-emitting means being preferably detected. When a resonant halfbridge is used for operating the light-emitting means (that is to say, for example, in the case of an electronic ballast as operating device 10), the current flowing through the halfbridge can, for example, however, also be detected as parameter for the power of the light-emitting means. But the energy or power measuring device 25 can also detect, for example, the power consumed by the operating device 10 at the input terminals or via an existing power factor correction circuit.

According to one exemplary embodiment, the energy or power measuring device 25 can thus be constructed in such a manner that, when the light-emitting means 12 is operated by means of a resonant halfbridge, a current and a voltage through the light-emitting means 12 or through the resonant halfbridge are detected.

According to a further exemplary embodiment, the energy or power measuring device 25 can be constructed for detecting in a detection mode the energy or power losses occurring in the operating device 10 in dependence on a particular operating state, that is to say, e.g., a particular dimming or brightness value, and storing these. These values can be used in the determination of the current energy or power consumption values.

The energy or power measuring device 25 can enable accurate instantaneous energy or power consumption values to be detected for an operating device 10 for a light-emitting means. The operating device 10 can then send this information about the energy or power consumption, which has been determined or detected with the aid of the energy or power measuring device 25, to a control device 20 or make this information about the energy or power consumption accessible to the control device 20.

The energy or power measuring device 25 can be constructed in such a manner that it can determine the losses occurring in the operating device 10. For example, the energy or power measuring device 25 can record the corresponding losses for all possible dimming values or brightness values in a type of detection mode. These detected losses corresponding to the dimming values or brightness values can be taken into consideration later in the operation during the determination of the current energy or power consumption.

Figure 8:
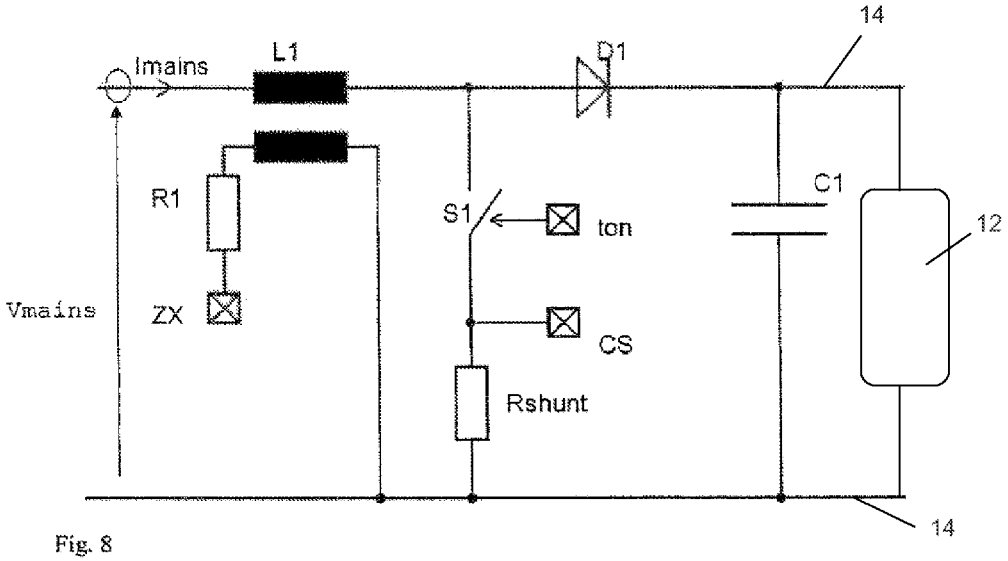
FIG. 8 shows a representation of a power factor correction circuit of an operating device for a light-emitting means according to a further exemplary embodiment of the present invention.

According to an exemplary embodiment, the energy or power measuring device 25 can be constructed for detecting the energy or power, consumed by the operating device 10, at associated current/voltage input terminals of the operating device 10, illustrated in the embodiment of FIG. 8 as Imains and Vmains, or via a power factor correction circuit, also illustrated in FIG. 8.

A detection via a power factor correction circuit can be carried out, for example, in such a manner that the current consumed by the power factor correction circuit is detected and additionally the voltage present at the input of the power factor correction circuit is detected. From these detected values for the current consumed by the power factor correction circuit and the voltage applied, the power and also energy consumed can be determined.

By means of FIG. 8, it is intended to explain a possible exemplary embodiment for a detection of the energy or power consumed at the power factor correction circuit.

FIG. 8 shows a typical power factor correction circuit which is constructed here as a step-up converter. In this arrangement, the switch S1 is timed at high frequency and, as a result, the coil L1 is alternately magnetized and demagnetized. The energy of magnetization of the coil L1 is transferred via the diode D1 into the buffer capacitor C1 which, in turn, is used for feeding the light emitter driver circuit (for example the resonant halfbridge), which powers light emitter means 12 via lead wires 14. A current measuring resistor Rshunt can be arranged in series with the switch S1, which resistor can be used, for example, for monitoring the current within the power factor correction circuit (by means of a detection at point CS). Whenever the switch S1 is turned on, the current Imains, which magnetizes the coil L1, also flows through the switch S1 and the current measuring resistor Rshunt. In the turn-off phase of the switch S1 when the coil L1 is demagnetized, the current flows from the coil L1 through the diode D1 and not through the switch S1. The time of demagnetization of the coil L1 can be determined by means of a measurement, for example by means of a secondary winding at the coil L1 at point ZX. However, since both the value of the coil current Imains on opening of the switch S1 and the duration of the demagnetization of the coil L1 are known, the current flow during the turn-off phase can also be determined from this.

Figure 9:
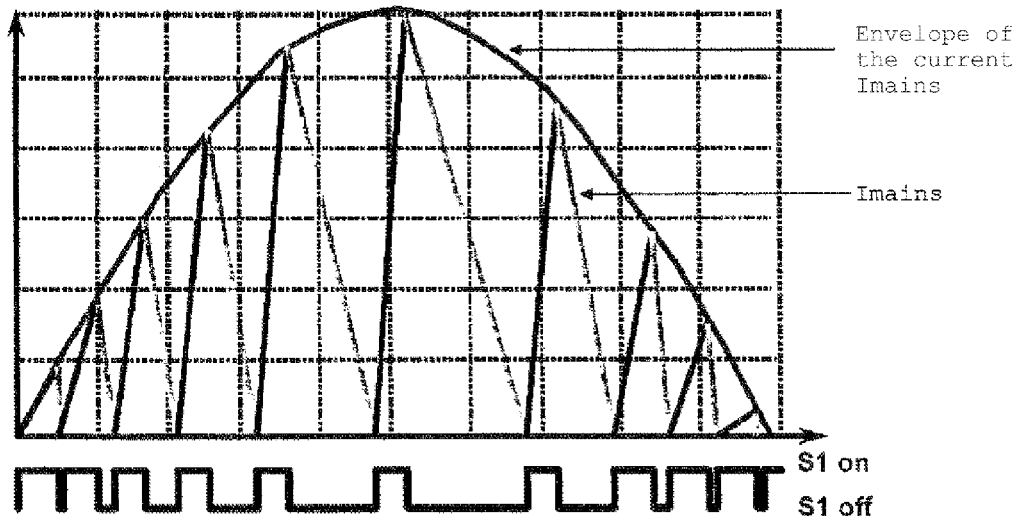
FIG. 9 shows a representation of the signal variations of a power factor correction circuit according to a further exemplary embodiment of the present invention.

A typical variation of the current flow through the coil L1 in dependence on the timing of the switch S1 is shown symbolically in FIG. 9. The rising edge of the current Imains through the coil L1 also corresponds to the current through the current measuring resistor Rshunt. As already explained, the falling edge flows through the diode D1. As already explained, the variation of the falling edge can be determined by means of the value of the current Imains through the coil L1 on opening of the switch S1 and the duration of the demagnetization of the coil L1. Thus, the current consumed by the power factor correction circuit can be determined. As an alternative, other types of current detection can also be used, for example by means of a current measuring transformer or a current measuring resistor arranged differently.

As can be seen in FIG. 9, the envelope of the current Imains through the coil L1 follows a sinusoidal variation. This is due to the sinusoidal system voltage since the power factor correction circuit attempts to adapt the current consumption to the variation of the system voltage and thus to ensure a high power factor.

The voltage present at the input of the power factor correction circuit can also be determined in various ways. One possibility would be a measurement via the existing detection of the input voltage which is often present in power factor correction circuits (for example the input voltage detection for the multiplier input of the power factor correction regulating circuit). Such a measurement could take place, for example, at the input of the power factor correction circuit at point Vmains. However, for example, a measurement at an existing circuit for distinguishing an AC or DC feed operation could also be used or an indirect detection of the input voltage, for example via the evaluation of the duty ratio of the switch S1 of the power factor correction circuit (paying attention to the output voltage across the buffer capacitor C1), could be carried out.

If the voltage and the current through the power factor correction circuit are known, the power consumed can be determined by multiplying these values and the energy consumed can also be determined further.

The energy or power measuring device 25 can also be constructed in such a manner that the power consumed by the operating device 10 is detected at the input terminals or via an existing power factor correction circuit, and furthermore also the power delivered to the light-emitting means is detected additionally. In this way, the energy consumption and the power loss within the operating device 10 can also be determined. In addition, the efficiency of the operating device 10 can thus be detected. It is thus possible to determine, and also regularly monitor, the energy consumption and the power loss of the operating device 10. In the case of a deterioration of the power loss, this state can also be signaled by the operating device 10, for example. Furthermore, it is also possible that the energy or power measuring device 25 both determines the energy consumption or the power loss within the operating device 10 and additionally also detects the energy consumption or the consumed power of the light-emitting means.

The energy or power measuring device 25 can also be constructed in such a manner that the energy or power consumption is calculated via the dimming value or brightness value set for the light-emitting means. This can be done in that, for each operating device of an illumination system, a list is provided in which the power consumption of the operating device is documented per dimming value or brightness value set, respectively. Apart from the dimming value, the corresponding operating time of the light-emitting means and the respective type of the light-emitting means can then also be stored in order to obtain an energy consumption—that is to say power multiplied by the corresponding time. Such a list can be stored, for example, in a memory of the operating device.

The energy or power measuring device 25 can thus be constructed for determining the energy or power consumption of a light-emitting means in an operating state, that is to say, e.g., at a particular dimming or brightness value, with the aid of a value, allocated to the respective operating state, in a list of energy and power consumption values of the operating device.

In this context, the operating device 10 can be constructed in such a manner that, following a request by the control device or else intermittently, it independently sends information about the energy or power consumption determined by the energy or power measuring device 25 to the control device 20, for example via the interface 15.

According to an exemplary embodiment of the present invention, the control device 20 can request or read out information about the energy or power consumption of the operating device 10 via control commands which are sent to this operating device, for example via the bus 16. In other exemplary embodiments of the present invention, the operating device 10 can also be constructed, however, for sending this information with respect to the energy or power consumption to the control device 20 sporadically and independently, depending on the loading of the bus system 16. The operating device 10 can also be constructed in such a manner that it sends, or renders accessible, the information relating to the energy or power consumption to the control device 20 at predetermined times or points in time or in the case of certain events. Such an event could be, e.g., that a dimming or brightness value of the light-emitting means is changed and, following this, information with respect to the energy or power consumption in this new setting of the light-emitting means is conveyed to the control device 20.

Figure 2:
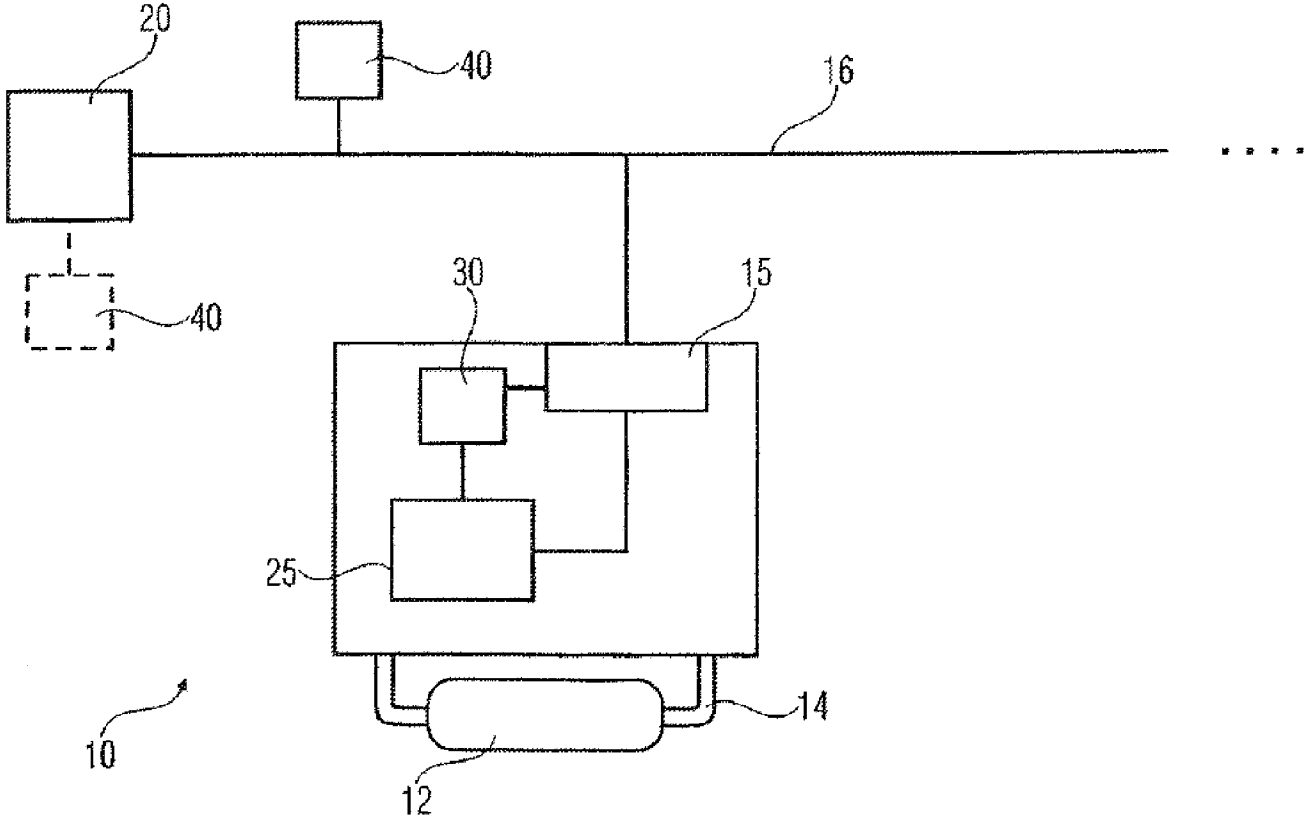
FIG. 2 shows a diagrammatic representation of an operating device for a light-emitting means with a data memory according to a further exemplary embodiment of the present invention.

As is shown in a further exemplary embodiment in FIG. 2, an operating device 10 can have, apart from the components already mentioned in conjunction with FIG. 1, a data memory 30 which is coupled to the energy or power device so that the information about the energy or power consumption can be stored in the data memory. The data memory 30 can be readable by the control device 20, for example via the interface 15.

As is also shown in FIG. 2, a control unit 40 can be connected to the bus system 16, by means of which control unit, for example, a lamp can be dimmed, that is to say the brightness can be changed. Such control units 40 can also be connected to the bus system 16 in other exemplary embodiments of the invention. The control unit 40 can be, for example, a motion sensor, a brightness sensor, a pushbutton, an on- and off-switch, a dimmer, a control panel, a touch panel etc., for controlling or operating the operating devices. The control unit 40 can thus be an operating element for an operating device. According to further exemplary embodiments, such a control unit 40 can also be connected directly to the control device 20 as has already been described in conjunction with FIGS. 6 and 7. The control device 20 can then forward, for example, a control command from a control unit 40 to the operating device 10. The control device 20 can be a DALI control device which is coupled to a DALI operating device 10 via a DALI bus 16. Correspondingly, the control device can be constructed for establishing the logical correlation between the control units 40 and the DALI operating devices 10 in a DALI illumination system.

An operating device 10 for a light-emitting means 12 can record information about the energy or power consumption in a data memory 30 such as, e.g., a memory bank, over a certain period of time. For example, an averaged energy or power consumption value can thus be determined or detected by integration of the energy or power consumption values over a certain period of time. In exemplary embodiments of the present invention, the information about the energy or power consumption can comprise an energy or power consumption averaged over time or else, for example, an instantaneous energy or power consumption.

Figure 3:
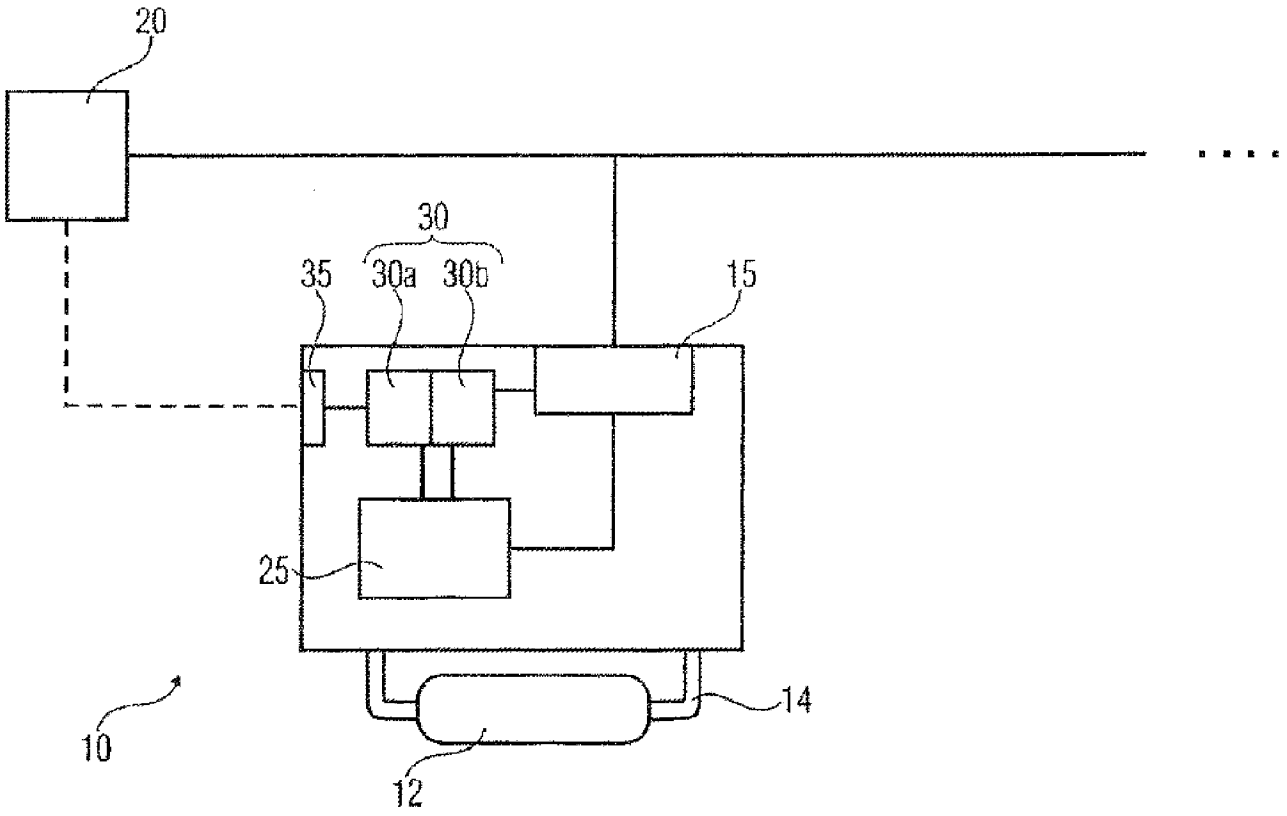
FIG. 3 shows the diagrammatic representation of an operating device for a light-emitting means with a further interface and two memory banks for storing a current consumption value and for storing an energy or power consumption value over a certain period of time according to a further exemplary embodiment of the present invention.

According to a further exemplary embodiment which is shown diagrammatically in FIG. 3, the operating device 10 can have a further interface 35. Via this interface 35 which can be coupled to a data memory 30 or the energy or power measuring device 25, stored information about the energy or power consumption can then be readable. This second interface 35 can also be, for example, a wireless interface in which the data and information are transmitted by radio, e.g. according to the Bluetooth standard. Information about the energy or power consumption can then be conveyed, for example, wirelessly to a control device 20. However, it is also conceivable that the further interface 35 is a wire-connected interface which, in comparison with the interface 15, has a different transmission protocol so that the information about the energy or power consumption can also be sent to other further devices for evaluation or read out by these, respectively, independently of a DALI protocol. The information can also be conveyed to the control device 20 via the interface 35.

As is shown diagrammatically in FIG. 3, a data memory 30 can have different memory banks 30*a*, 30*b* or registers according to an exemplary embodiment of the present invention, wherein, for example, in a first register 30*a*, information about the energy or power consumption is stored over a certain period of time whilst, for example, current information about energy or power consumption of the operating device 10 with light-emitting means 12 is always stored in a second register or a second memory bank 30*b*. This information can then be called up or transmitted as required.

As has already been specified above, the operating device 10 can be constructed, according to exemplary embodiments of the present invention, so that information about the energy or power consumption is sent to the control device 20, or made accessible to the control device 20, intermittently, continuously, in periodic time intervals, at predetermined points in time, with a predetermined energy or power consumption value or following a command for changing a brightness of the light-emitting means. In this arrangement, the reading can be done, e.g., via a wireless further interface 35 or via the interface 15 which, for example, can operate in accordance with the DALI protocol.

The interfaces 15 and 35 can be interfaces for bidirectional data exchange, that is to say it is possible to both send and receive via these interfaces. Thus, for example, control commands can be received and status information or data such as, e.g., information about the energy or power consumption can be sent by the operating device 10. The interface 15 for bidirectional data exchange can be constructed for receiving external control commands for the operation of the light-emitting means 12 according to the DALI protocol and sending status information or data information according to the DALI protocol.

Figure 4:
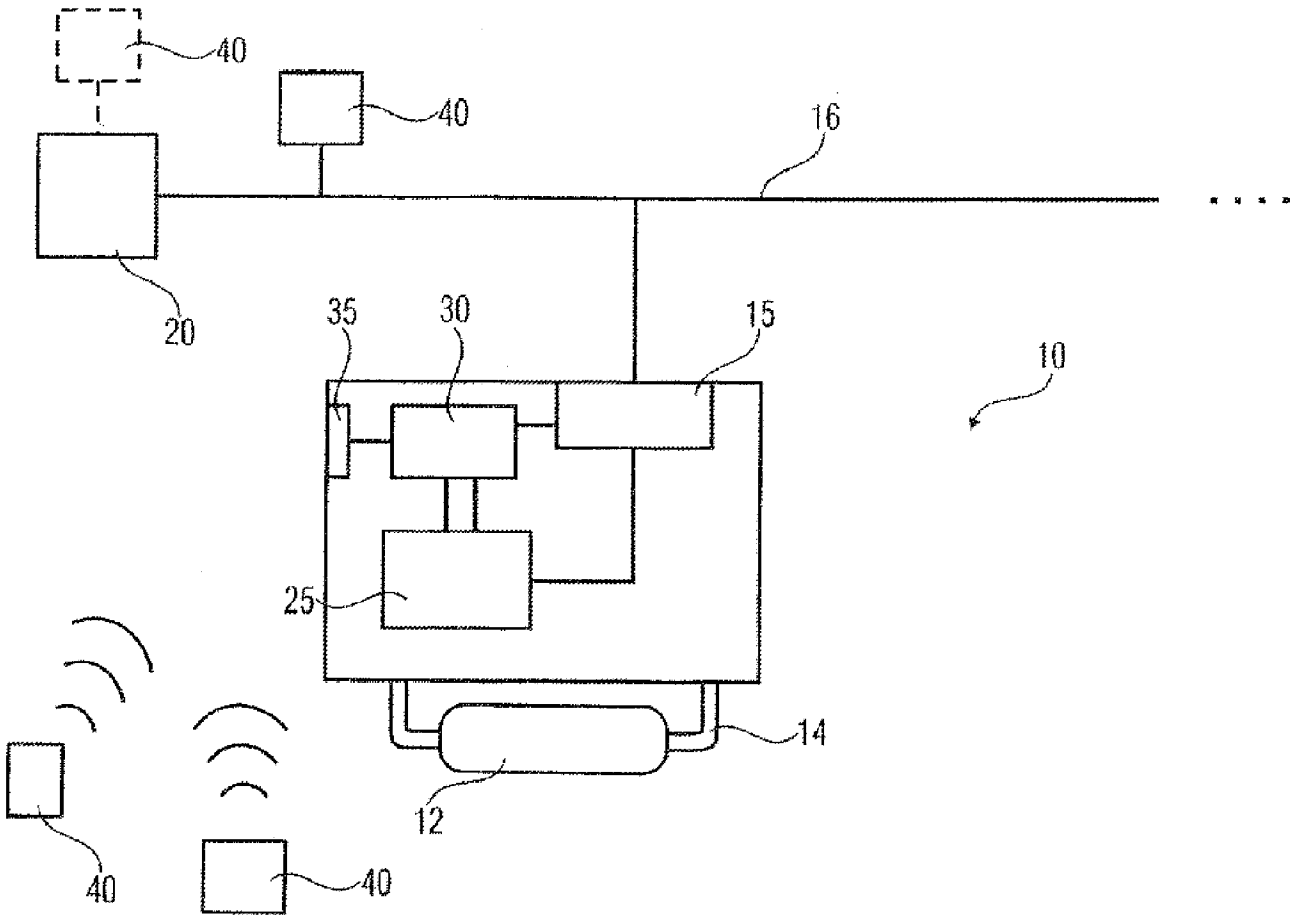
FIG. 4 shows a diagrammatic representation of an operating device for a light-emitting means, wherein the operating device has a wireless interface for the transmission of information relating to the energy or power consumption or, respectively, of control commands according to a further exemplary embodiment of the present invention.

As is shown in FIG. 4 according to a further exemplary embodiment, the operating device 10 can also have a further interface 35 via which the information relating to the energy or power consumption can be conveyed to the control device 20 or another device for evaluation of this information, or read out, by radio or wirelessly. According to some exemplary embodiments, the operating device 10 can also receive control commands for controlling the operating characteristic of the light-emitting means 12 via a remote control 45. Furthermore, it is also conceivable that the control units 40 can communicate with the control device 20 by radio in order to then convey control commands to an operating device 10 via the bus line 16. The operating device 10 can thus also be constructed for receiving control commands for the operation of the light-emitting means from a control unit 40 via an interface 15 or 35. For example, a dimming or brightness value can thus be set via a control unit 40, whereupon information about the energy or power consumption of the operating device 10 for light-emitting means 12 in this dimming value set is sent or made accessible to a control device 20.

As shown diagrammatically in FIG. 4, the further interface can be connected to the data memory 30 wherein, in alternative exemplary embodiments of the present invention, the interface 35 does not need to be coupled directly to the data memory.

Generally, a current and voltage supply for the operating device with the light-emitting means 12 can also be contained via the bus line 16. As an alternative, however, there can also be a separate current and voltage supply for the operating device via other feed lines.

The control device 20 can be a DALI control device or else, for example, a DALI gateway, that is to say a connecting element between different bus systems or bus networks such as, e.g., the DALI bus and other bus systems such as, e.g., the in-house bus systems EIB (European Installation Bus), LON (Local Operating Network) or the C bus.

Due to the installation of the energy or power measuring device in an operating device 10, an accurate energy balance can be created for each correspondingly equipped operating device and provided by a control device 20. A control device 20 can be connected, for example, to a computer so that, among other things, information about the energy or power consumption can be requested or received by certain operating devices via software instructions to the control device.

Thus, using the integrated energy or power measuring device 25, an accurate actual energy or power consumption value can be determined. In this context, it is not necessary to access lists or stored consumption values at certain dimming settings. In an illumination system with control device 20 and integrated operating device 10, different operating devices with different light-emitting means can be installed so that each operating device can have a different energy or power consumption. Due to the integration of the energy or power measuring device 25 in operating devices 10, it is possible to determine in a simple but nevertheless extremely accurate manner the energy or power consumption for each of these different operating devices for the associated light-emitting means, and send it to the central control device 20 or read it out by means of the latter. Furthermore, the energy or power consumption of a group of light-emitting means connected together which are allocated to an operating device according to the invention can also be determined with the aid of the energy or power measuring device 25 and corresponding information relating to the energy or power consumption can be sent to a control device 20 or made accessible to the latter.

Figure 5:
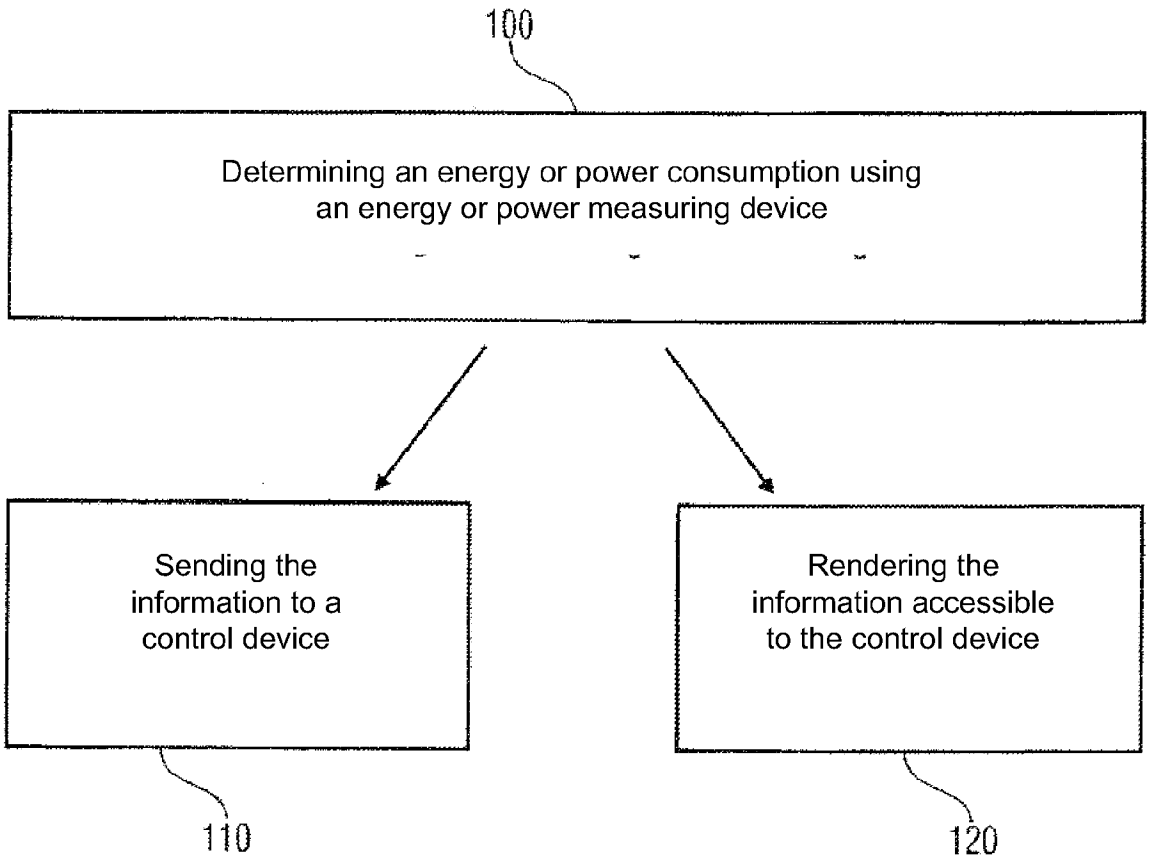
FIG. 5 shows a flowchart for a method for detecting information of an energy or power consumption of a light-emitting means according to an exemplary embodiment of the present invention.

As is shown in the flowchart in FIG. 5, the invention thus also comprises a method for detecting information of an energy or power consumption of a light-emitting means with an operating device. The operating device has an interface for the bidirectional data exchange with a control device and also an energy or power measuring device for determining an energy or power consumption. According to an exemplary embodiment of the present invention, the method comprises a step of determining 100 information about the energy and power consumption with the aid of the energy or power measuring device. Furthermore, the method comprises sending 110 the information about the energy or power consumption to a control device or rendering accessible 120 the information about the energy or power consumption to the control device.

According to a further exemplary embodiment of the present invention, the method can have, after the step of determining 100, also a step of storing the information about the energy or power consumption on a data memory of the operating device for light-emitting means. This means, therefore, that the data which have been determined or measured by the energy or power measuring device can be stored on a memory, present in the operating device, for digital data. From there, they can be sent to the control device or read out by the latter. According to exemplary embodiments, the step of sending 110 the information about the energy or power consumption or rendering accessible 120 this information can be carried out following a request by a control device or intermittently independently. The sending of information about the energy or power consumption can thus be carried out in such a manner that, on the basis of an external control command, the corresponding information is sent to the control device. It is also conceivable that the information can be read out also at predetermined times or predetermined time intervals or on the basis of certain events, by a control device, or sent to the latter. Such an event can be, for example, the switching-on or -off of the operating device for light-emitting means or else, for example, a change of the brightness or dimming value for such an operating device.

The step of sending 110 the information about the energy or power consumption or the step 120 of rendering the same information accessible can be carried out in exemplary embodiments, for example, intermittently or temporarily stopping, at periodic time intervals, at predetermined points in time or times, with a predetermined energy or power consumption value or following a command for changing a brightness of the light-emitting means.

In particular, it is also pointed out that, in dependence on the given situations, the method or scheme according to the invention can also be implemented in software. The implementation can be carried out in a digital storage medium, particularly a diskette, a CD or DVD with electronically readable control signals which can interact with a programmable computer system in such a manner that the corresponding method is executed. Generally, the invention thus also comprises a computer program product with program code stored on a machine-readable medium for carrying out the method according to the invention when the computer program product is running on a computer or microprocessor. Expressed in other words, the invention can thus be implemented as a computer program with a program code for carrying out the method when the computer program is running on a computer.

The invention claimed is:

1. An operating device (10) for a light-emitting means (12), with an interface (15) for the bidirectional data exchange between the operating device (10) and a control device (20), wherein the operating device (10) has an energy or power measuring device (25) for determining an energy or power consumption of the light-emitting means and wherein the operating device (10) sends information about the energy or power consumption to the control device (20) or the information about the energy or power consumption is accessible to the control device (20), wherein the energy or power measuring device (25) measures the energy or power consumption by the operating device (10), wherein the energy or power measuring device (25) measures said consumption at associated current/voltage input terminals of the operating device or via a power factor correction circuit, wherein the energy or power measuring device (25) detects and stores the energy or power losses occurring in the operating device (10) in dependence on an operating state of the operating device in a detection mode.

2. The operating device as claimed in claim 1, wherein the operating device (10) sends information about the energy or power consumption, determined by the energy or power measuring device (25), to the control device (20) via the interface (15) on request by the control device (20) or intermittently independently.

3. The operating device (10) as claimed in claim 1, which furthermore has a data memory (30) which is coupled to the energy or power measuring device (25) so that the information about the energy or power consumption can be stored in the data memory (30).

4. The operating device as claimed in claim 3, which also has a further interface (35) which is coupled to the data memory (30) so that stored information about the energy or power consumption can be read out or sent via the further interface (35).

5. The operating device as claimed in claim 1, wherein the information about the energy or power consumption is an energy or power consumption averaged over time or an instantaneous energy or power consumption.

6. The operating device (10) as claimed in claim 1, wherein the operating device (10) sends to the control device (20) or rendering accessible to the control device (20) the information about the energy or power consumption intermittently, continuously, at periodic time intervals, at predetermined points in time, with a predetermined energy or power consumption or following a command for changing a brightness of the light-emitting means.

7. The operating device (10) as claimed in claim 1, wherein the operating device (10) receives control commands for the operation of the light-emitting means from a control unit (40) via the interface (15).

8. The operating device (10) as claimed in claim 1, wherein the bidirectional data exchange comprises control commands, status messages or information relating to the energy or power consumption.

9. The operating device (10) as claimed in claim 1, wherein the operating device (10) comprises a DALI (Digital Addressable Lighting Interface) control device and a DALI interface (15) which exchanges data bidirectionally with a control device (20) according to a DALI protocol.

10. The operating device (10) as claimed in claim 1, wherein the operating device (10) comprises an electronic ballast (10) for discharge lamps (12).

11. The operating device (10) as claimed in claim 1, wherein the energy or power measuring device (25) determines the energy or power consumption of the light-emitting means (12) in an operating state with the aid of a value allocated to the respective operating state in a list of energy and power consumption values.

12. The operating device (10) as claimed in claim 1, wherein the energy or power measuring device (25) detects, in the case of an operation of the light-emitting means (12) by means of a resonant halfbridge, a current and a voltage through the light-emitting means or through the resonant halfbridge.

13. A method for detecting an energy or power consumption of a light-emitting means with an operating device, wherein the operating device has an interface for the bidirectional data exchange between the operating device and a control device and wherein the operating device has an energy or power measuring device for determining an energy or power consumption, wherein the energy or power measuring device (25) measures the energy or power consumption by the operating device (10), wherein the energy or power measuring device (25) measures said consumption at associated current/voltage input terminals of the operating device or via a power factor correction circuit, wherein the energy or power measuring device (25) detects and stores the energy or power losses occurring in the operating device (10) in dependence on an operating state of the operating device in a detection mode, comprising the following steps:

determining (100) information about the energy or power consumption with the aid of the energy or power measuring device, and sending (110) the information about the energy or power consumption to the control device, or rendering accessible (120) the information about the energy or power consumption to the control device.

14. The method as claimed in claim 13, which also has a step of storing the information, detected with the aid of the energy or power measuring device, about the energy or power consumption on a data memory of the operating device.

15. The method as claimed in claim 13, wherein the step of sending (110) the information or the step of rendering accessible (120) the information about the energy or power consumption is carried out following a request by the control device or the operating device sends the information about the energy or power consumption to the control device (20) intermittently and independently, following a request by the control device.

16. The method as claimed in claim 13, wherein the step of sending (110) the information about the energy or power consumption or the step of rendering accessible (120) the information about the energy or power consumption is carried out intermittently, continuously, in periodic time intervals, at predetermined points in time, with a predetermined energy or power consumption or following a control command for changing a brightness of the light-emitting means.

17. A computer program for carrying out the method as claimed in claim 13 when the computer program is executed on a computer.

18. An operating device (10) operably connected to a light-emitting means (12), wherein the operating device (10) comprises:

an interface (15) that exchanges data bidirectionally with a control device (20); and an energy or power measuring device (25) that determines an energy or power consumption of the light-emitting means, wherein the operating device (10) sends information via the interface (15) about the energy or power consumption to the control device (20) or the information about the energy or power consumption is accessible to the control device (20) via the interface (15), wherein the energy or power measuring device (25) measures the energy or power consumption by the operating device (10), wherein the energy or power measuring device (25) measures said consumption at associated current/voltage input terminals of the operating device or via a power factor correction circuit, wherein the energy or power measuring device (25) detects and stores the energy or power losses occurring in the operating device (10) in dependence on an operating state of the operating device in a detection mode.

* * * * *